United States Patent [19]

Garbett

[11] Patent Number: 4,995,458

[45] Date of Patent: Feb. 26, 1991

[54] WEAR BUSHING RETRIEVAL TOOL

[75] Inventor: Keith Garbett, Castleford, England

[73] Assignee: Cooper Industries, Inc., Houston, Tex.

[21] Appl. No.: 434,345

[22] Filed: Nov. 9, 1989

[51] Int. Cl.[5] ..... E21B 17/12

[52] U.S. Cl. ..... 166/85; 294/86.1; 294/86.25

[58] Field of Search ..... 166/85, 98, 242, 301, 166/377; 294/86.1, 86.14, 86.24, 86.25

[56] References Cited

U.S. PATENT DOCUMENTS

| | | | |
|---|---|---|---|
| 3,247,914 | 4/1966 | Slack | 175/7 |
| 3,473,608 | 10/1969 | Castille | 166/85 X |
| 3,645,328 | 2/1972 | Greene, Jr. | 166/85 |
| 3,901,546 | 8/1975 | Piazza et al. | 294/86.1 |
| 4,067,388 | 12/1982 | Green | 166/85 |
| 4,340,259 | 7/1982 | Green | 308/4 |
| 4,361,353 | 11/1982 | Vinson | 294/86.1 |
| 4,625,381 | 12/1986 | Gravouia, Jr. et al. | 294/86.1 X |
| 4,838,594 | 6/1989 | Bullard | 294/86.25 X |

*Primary Examiner*—William P. Neuder

[57] ABSTRACT

A tool for use in retrieving a wear bushing from a wellhead assembly comprising a generally annular body portion which can be located around a length of casing, means for supporting the body portion relative to a length of casing so that it can be lowered into a wellhead with said casing, latching means carried by body portion, said latching means being so shaped and arranged that it can engage a correspondingly shaped portion on said wear bushing, and means for actuating the latching means to move it into engagement with the wear bushing.

12 Claims, 8 Drawing Sheets

WEAR BUSHING RETRIEVAL TOOL

This invention relates to the formation of oil and gas wells.

In well drilling operations, during completion of a wellhead system lengths of casing are run through a casing or tubing spool. In order to protect the seal bore of the casing or tubing spool, it is known to provide a wear bushing which is located in a bowl formed on the wall of the spool bore in order to protect that well from damage which can be caused during drilling operations. The wear bushing normally has to be removed before a casing run is started. This means that the bore will be unprotected while lengths of casing are run through it.

U.S. Pat. No. 4,340,259 discloses a wear and guide bushing used to protect the casing head or tubing head bowl during drilling and includes an inner tapered ring to guide the casing sections and a plurality of outer lugs to support the ring in the bowl. This structure is to eliminate abrasion of the bowl by return flow of drilling fluid.

U.S. Pat. No. 3,247,914 discloses a protector which is run on the drill bit and landed in the casing head bowl. It is picked up by the bit for retrieval The structure is provided to avoid tilting and jamming of the protector during removal.

U.S. Pat. No. 4,362,210 discloses a wear bushing which is landed within a wellhead on the casing which is supported by slips whose bowl are landed on the wellhead landing seat. The wear bushing includes annular packing for sealing between its exterior and the interior of the bushing and also a semicircular flange structure for engagement by a running and retrieving tool.

SUMMARY

According to the present invention, there is provided a tool for use in retrieving a wear bushing from a wellhead assembly comprising a generally annular body portion which can be locked around a length of casing, means for supporting the body portion relative to a length of casing so that it can be lowered into a wellhead with said casing, latching means carried by body portion, said latching means being so shaped and arranged that it can engage a correspondingly shaped portion on said wear bushing, and means for actuating the latching means to move it into engagement with the wear bushing.

An object of the present invention is to provide a means for removing the wear bushing which allows such bushing to be removed at a relatively late stage in the completion of the wellhead system.

BRIEF DESCRIPTION OF THE DRAWINGS

The invention will be described now by way of example only, with particular reference to the accompanying drawings wherein.

DESCRIPTION OF THE PREFERRED EMBODIMENTS

Figure 1:
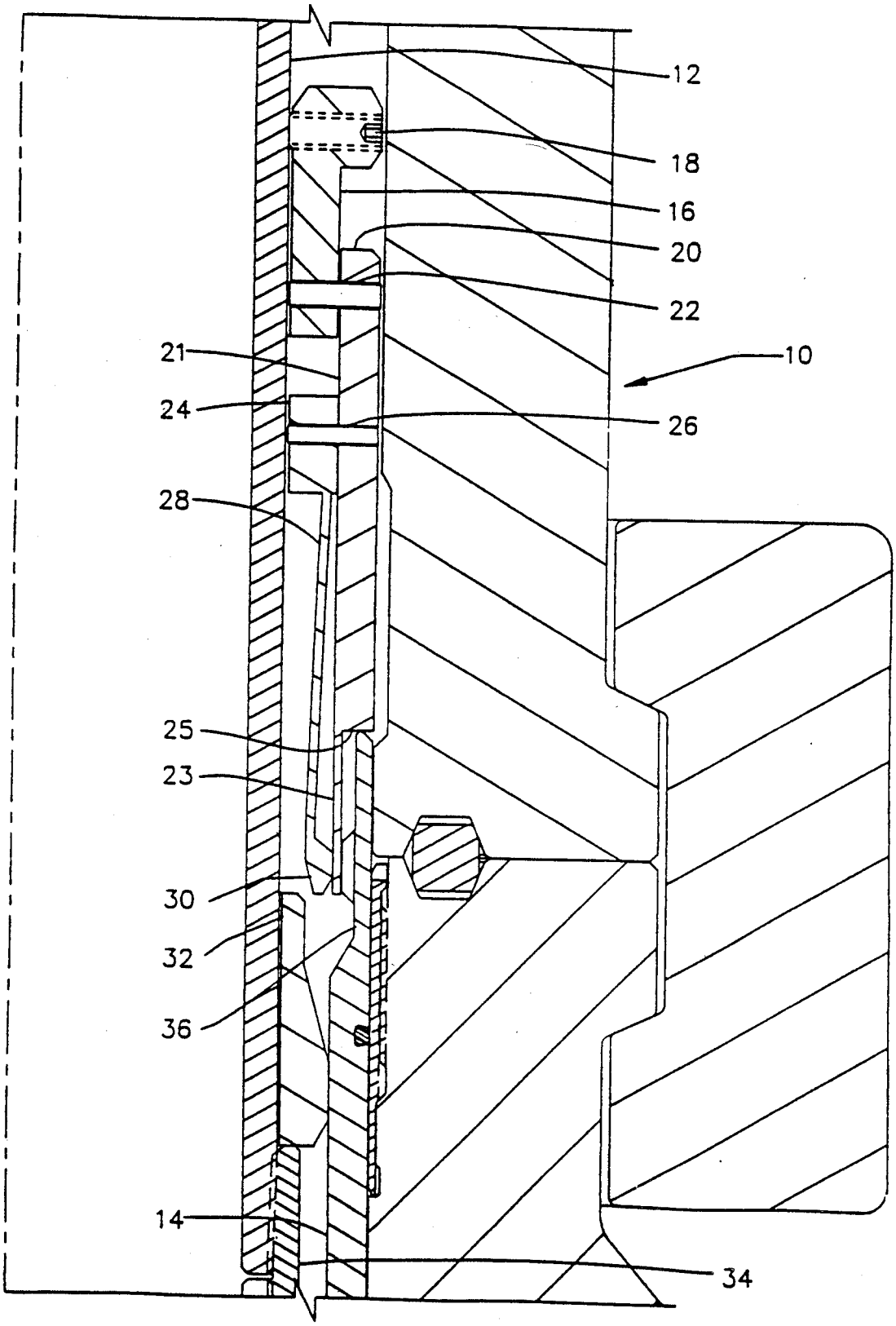
FIG. 1 is a partial sectional view of the improved wear bushing in position within the drilling riser for engagement therewith.

Referring to FIG. 1, there is shown a part of a wellhead system which includes a drilling riser through which lengths of casing 12 are run in order to complete the wellhead system. The drilling riser 10 is formed with a bowl into which fits wear bushing 14 in a manner which will be apparent to those skilled in the art. The wear bushing acts as a protector sleeve to protect the bore of the drilling riser from damage which could otherwise be caused as the lengths of casing are run through it.

The present arrangement is concerned particularly with a tool which allows retrieval of the wear bushing 14 towards the end of the completion of the wellhead system. In this embodiment of the invention, the tool comprises an upper split ring 16 which can be attached to a casing length by means of screws 18. An outer sleeve 20 is coupled to the upper split ring 18 by means of shear pins 22. The upper part 21 of the sleeve has a relatively thick wall while the lower part 23 has a relatively thin wall. A shoulder 25 is defined between the parts 21 and 23. A segmented latching ring 24 is carried by the outer sleeve 20 within the annular space between that outer sleeve and the casing length. The segmented latching ring comprises an upper body part which is secured to the outer sleeve by means of shear pins 26 and downwardly depending legs 28 which carry at their lower end enlarged feet portions 30. The tool also includes an energizing split ring 32 which can locate on a casing coupling 34 below the latching ring 24 as shown in FIG. 1 of the drawings. The inner surface of the energizing ring is tubular and generally of the same diameter as the outer surface of the casing portion 12 while the outer surface of the energizing ring is generally frusto-conical, the arrangement being such that the wall thickness of the split ring increases gradually towards its lower portion. It will be seen from FIG. 1 that the wear bushing 14 has a recess 36 and the foot 30 of the segmented latch ring is shaped to conform with the shape of the recess 36.

In operation, a hole is drilled in a conventional manner through the wear bushing located in the bore defined through the drilling riser. The wear bushing remains in position as the casing lengths are run into the hole as will be apparent to those skilled in the art.

At approximately 6 casing lengths from the required tube diameter, centralizers are not fitted to the casing lengths. The actual number of joints can vary depending upon the length of the blowout preventer stack and the drilling riser. At approximately three casing lengths from the required tube diameter, the tool of the present embodiment is secured to the outer surface of the casing length 12 as shown in FIG. 1 of the drawings. Initially, the energizing ring is located above the casing collar 34 as shown in FIG. 1, and then the remaining elements of the tool are secured to the outer surface of the casing length 12 by means of the screws 18. This casing length 12 is then lowered in a conventional manner until the downwardly facing shoulder 25 on the outer sleeve 20 lands on top of the upwardly facing upper surface of the wear bushing 14. This position is illustrated in FIG. 1 of the drawings. In this position, the feet 30 are held away from the wear bushing by the sleeve part 28.

Figure 2:
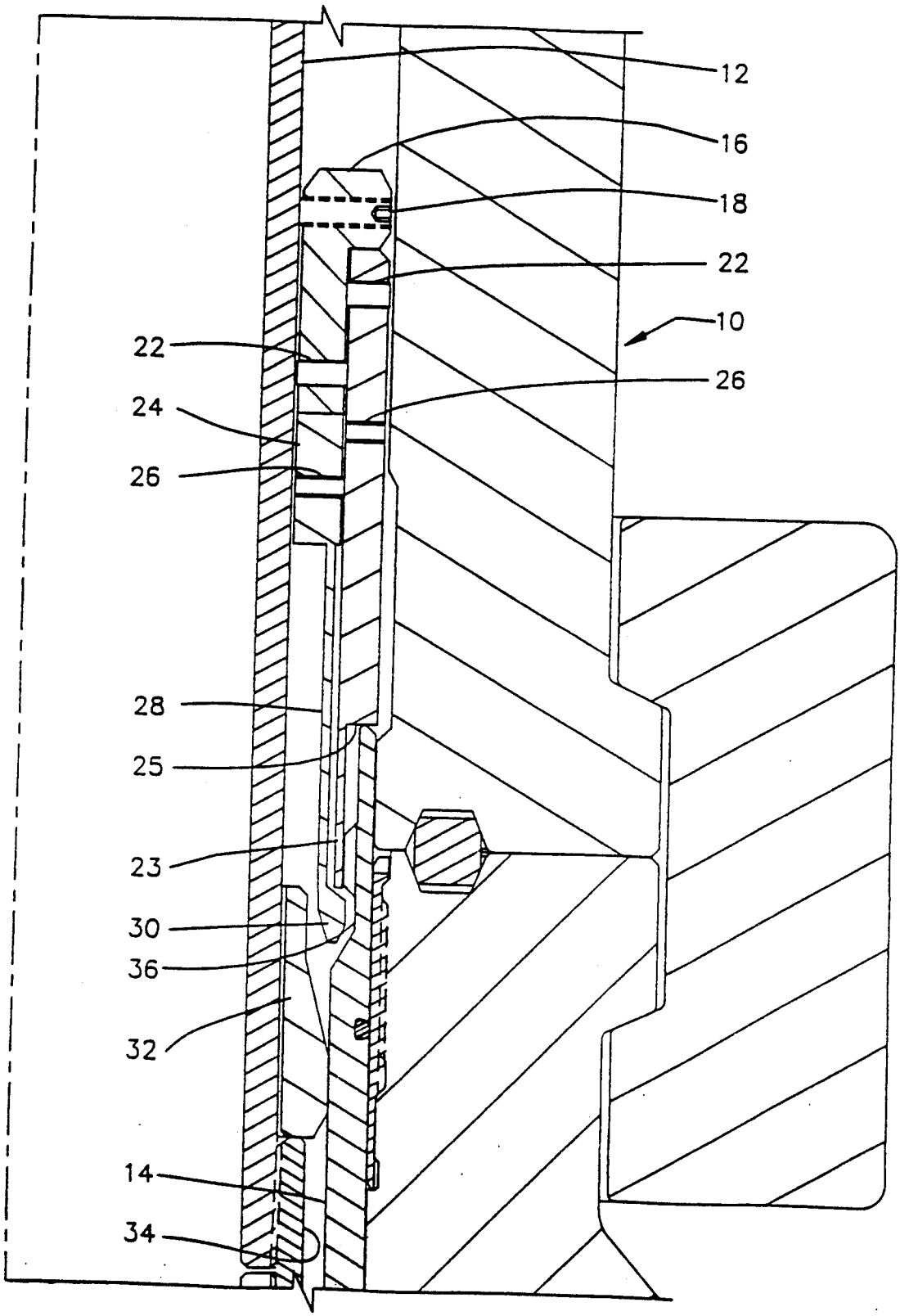
FIG. 2 is a similar view illustrating the first step in preparing for, securing the wear bushing within the drilling riser.

Continued lowering of the casing from the position shown in FIG. 1 initially causes the pins 22 to shear. This means that the upper ring 16 can move axially downwardly relative to the outer sleeve 22 as illustrated by FIG. 2 of the drawings. This further lowering causes the pins 26 to shear, and the result is that the segmented latch ring moves downwardly so that the elements 30 can move below the sleeve part 28 and outwardly into engagement with the recess 36 in the wear bushing.

Figure 3:
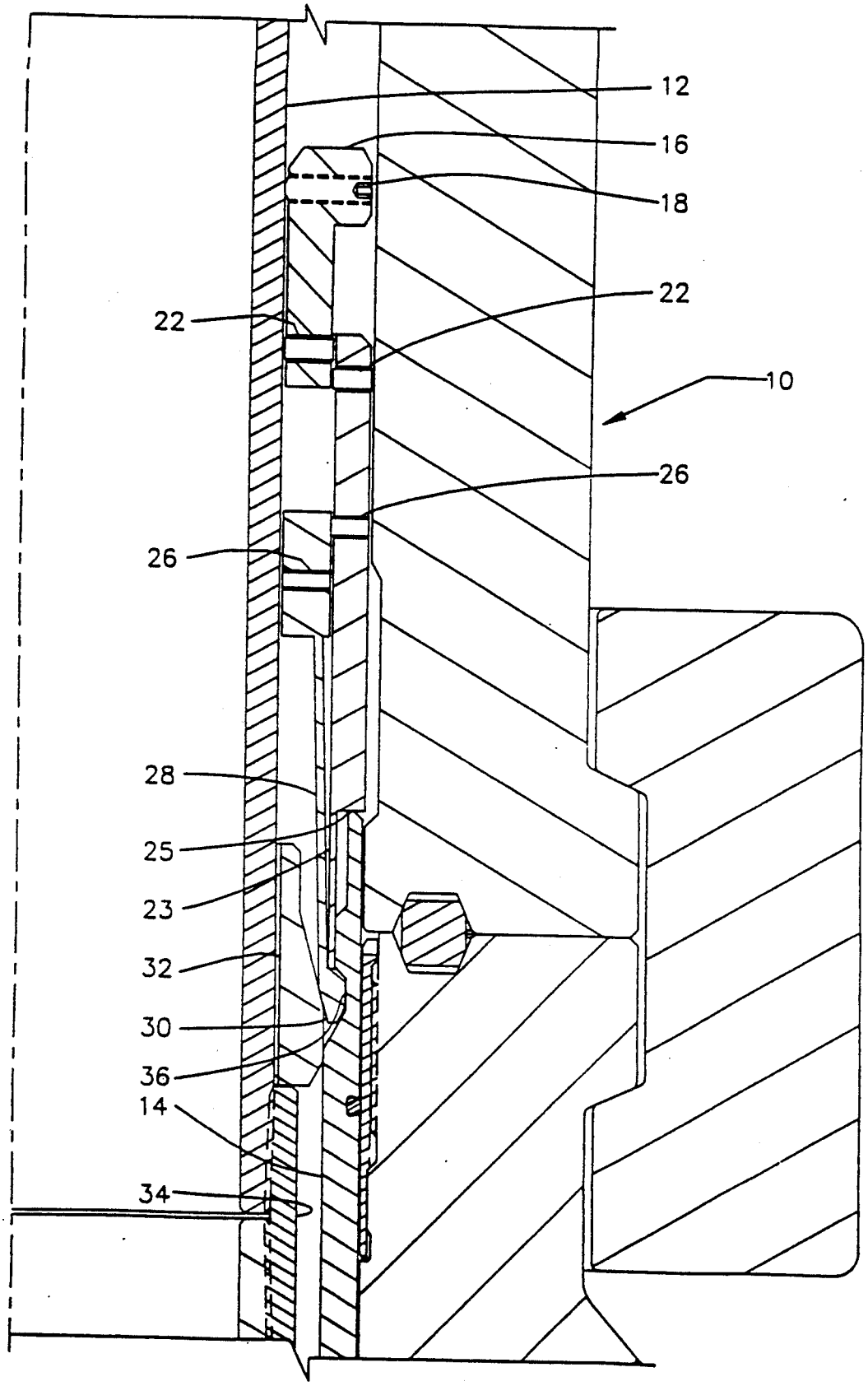
FIG. 3 is another similar view illustrating the latching of the wear bushing within the drilling riser.

To retrieve the wear bushing from the position shown in FIG. 3, the casing is pulled back to the surface to a position where access can be gained in order to retrieve the wear bushing. As shown in FIG. 3 of the drawings, the outer surface of the energizing split ring 32 engages the elements 30 and causes them to positively engage in the recess 36 of the wear bushing. Although not necessarily required, continued lowering of the casing does not transmit the weight of the casing through the wear bushing as the upper split ring strips over the casing at the screws 18. As will be apparent, raising of the casing will pull the wear bushing upwardly by virtue of the engagement of the elements 30 within the recess 36 of the bushing.

It will be appreciated that on land wellhead applications, the length of the blowout preventer stack and the drilling riser do not exceed the length of casing which can be handled in a rig derrick. It should therefore not be necessary to break out casing joints when retrieving the wear bushing.

Once retrieved, the tool shown in FIGS. 1 to 3 is removed, and further stands of casing are lowered through the wear bushing. The wear bushing is removed over the exposed casing connector prior to attachment of the casing hanger to complete the wellhead operations in a conventional manner.

A second embodiment of the invention is shown in FIGS. 3 to 6. In this embodiment of the invention, the casing is run through a drilling riser 110 in a manner similar to that described for the first embodiment The drilling riser 110 supports a wear bushing 114 as described also for the first embodiment. The wear bushing has a similar shaped recess 136.

Figure 4:
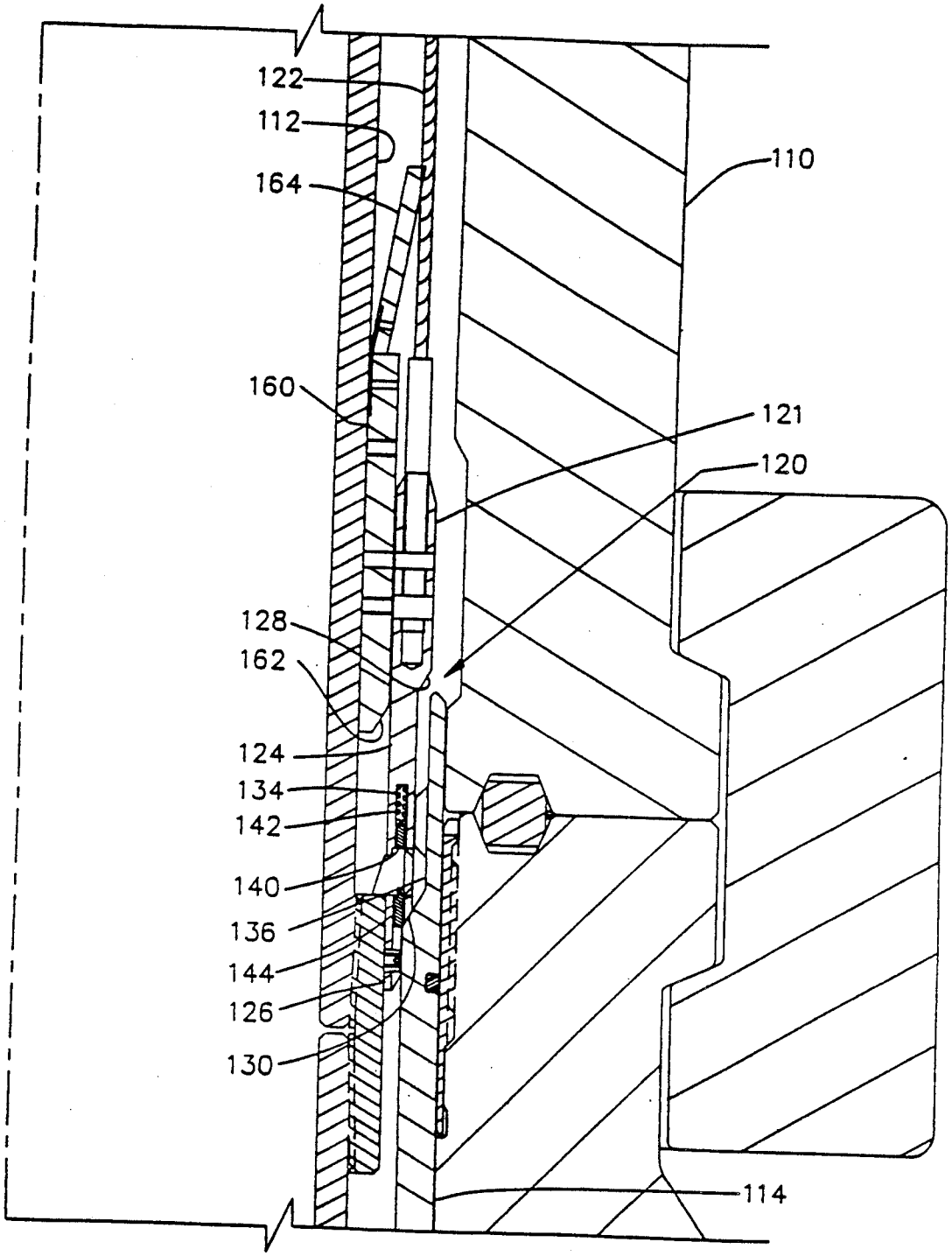
FIG. 4 is a partial sectional view of a modified form of wear bushing being positioned within the drilling riser.
Figure 4A:
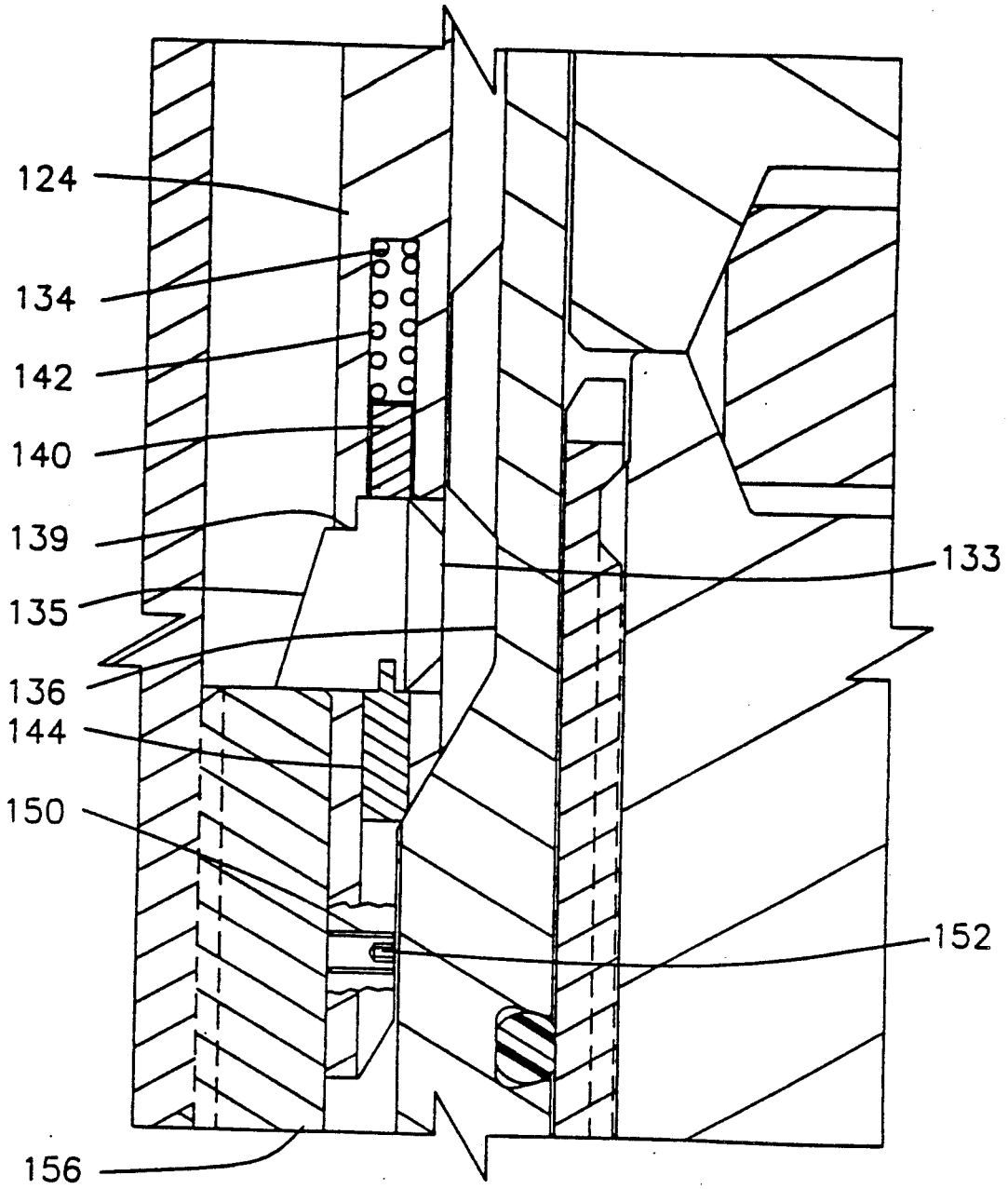
FIG. 4A is a detail sectional view illustrating the structure to the latching means.

The wear bushing retrieval tool of the second embodiment comprises a generally annular body portion 120 to the upper portion of which are connected upwardly extending lines 122. The tool body 120 has a first upper relatively thick body portion 121, an intermediate thinner body portion 124 and a lower relatively thin body portion 126. A downwardly facing shoulder 128 is formed at the junction of the upper and intermediate portions, and a second downwardly facing shoulder 130 is formed at the junction of the intermediate and lower portions. The intermediate body portion has radial through bores 132, only one of which is shown in FIG. 4. The radial through bore is in communication with an upwardly extending closed bore 134. The radial through bores accommodate latching dogs 138. The outwardly facing surface 133 of each latching dog is shaped to conform generally to the shape of the recess 136 formed in the wear bushing. The inwardly facing surface 135 of the latching dog is generally frusto-conical. The upper surface of each latching dog is stepped at 139. The upwardly extending closed bore 134 accommodates a pin 140 which is biased downwardly by means of a spring 142. In the position shown in FIG. 4A the pin 140 is in contact with the raised part of the stepped upper surface of the latching dog. As shown in FIG. 4(A) the lower surface of each latching dog 138 has a cut-away portion which accommodates an upwardly projecting pin 144.

The lower section 126 of the body portion has a through bore 150 which can receive screws 152 to enable the tool body to be secured to a casing collar 156.

The tool also includes an energizing and latching ring 160 which can be located between the tool body 120 and the outer surface of the casing portion 112. The energizing and latching ring is generally annular, but has a lower chamfered portion 162 on its outer surface The energizing and latching ring can be secured to the outer surface of the casing length 112. The energizing and latching ring has an upwardly extending portion 164 which is inclined slightly outwardly and upwardly.

Figure 5:
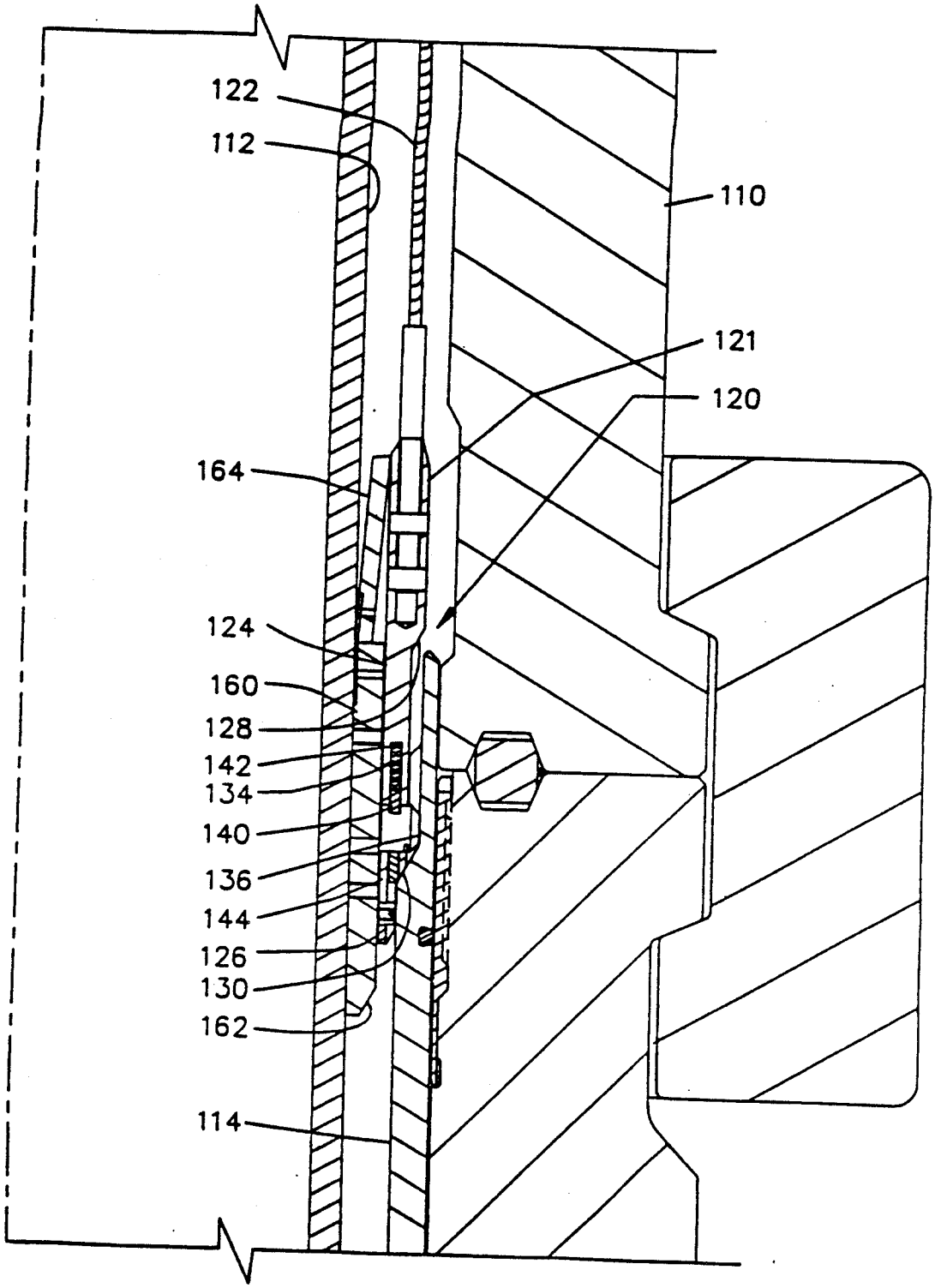
FIG. 5 is a partial sectional view of the wear bushing of FIG. 4 with the latching dogs positioned within the latching recess.
Figure 6:
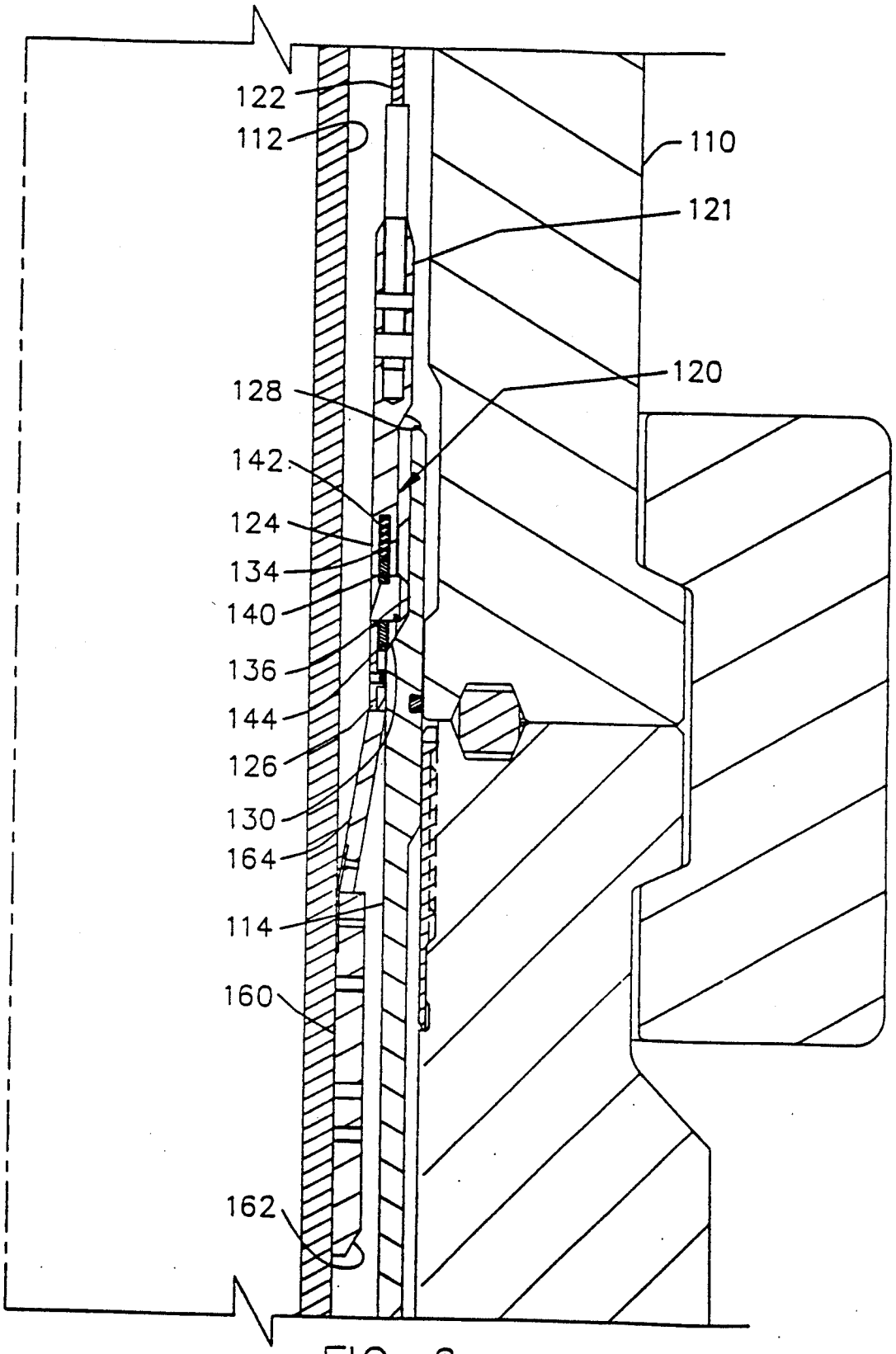
FIG. 6 is a similar view illustrating further lowering of the latching ring so that its bent portion engages below the lower end of the tool body.
Figure 6A:
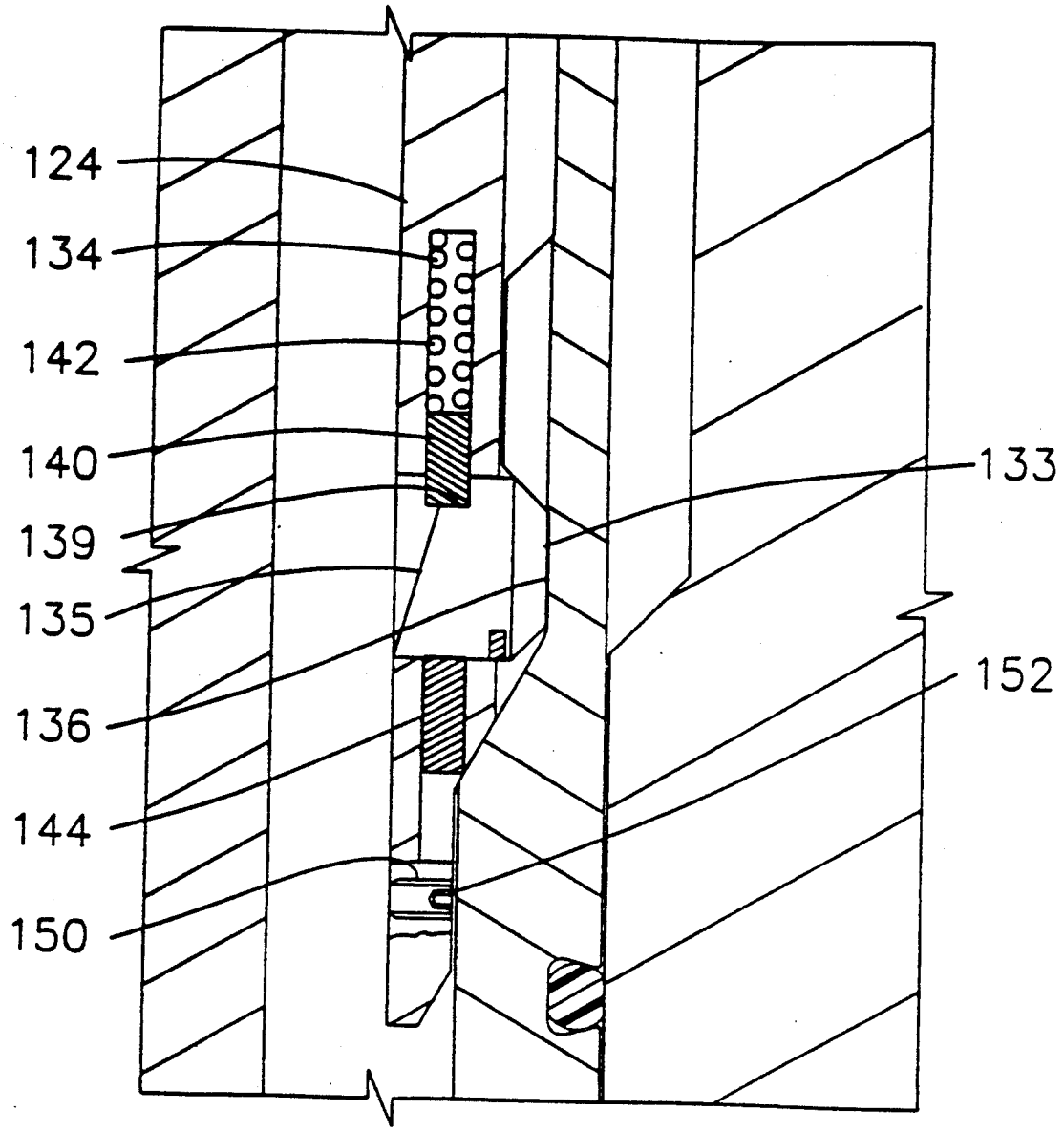
FIG. 6A is a detail sectional view to show the latching of latching dogs within the latching recess.

In operation casing lengths are run through the drilling riser in the conventional manner with the wear bushing 114 in place. This is carried out until approximately five joints from the required total depth. It should be noted that centralizers are not fitted to the last run of casing. At approximately three casing lengths from the required tube diameter the tool, shown in FIG. 4, is fitted to the outer diameter of a casing collar 156 by the means of screws, as shown in FIG. 4. The energizing and latching ring 160 is located in the annular space between the tool body 120 and the outer surface of the casing length 112. It will be noted that in this position the latching dogs 138 do not protrude beyond the outer surface of the intermediate body portion 124 and are held by pins 144. FIG. 4 shows one length of line 122 attached to the body portion 120, but it should be appreciated that there are three such lengths spaced angularly around the body. The casing is then run into the hole in a conventional manner, care being taken to monitor the feed of the lines 122. The length of line is monitored as the casing is lowered and when the shoulder 130 lands on the wear bushing 114, the line ceases to travel, thereby indicating that the tool has correctly landed on the wear bushing. This position is illustrated in FIG. 4 of the drawings. Continued lowering of the casing causes the screws coupling the tool body to the casing coupling to be stepped through so that the casing can then pass axially downwardly relative to the tool body. Continued downward movement of the casing causes the energizing and latching ring to engage the frusto-conical surface 138 on the latching dogs 130, thereby forcing the latching dogs radially outwardly into the recess 136 formed in the wear bushing. This is illustrated in FIG. 5 of the drawings. It should be noted that there are approximately eight latching dogs spaced equally angularly around the body of the retrieval tool. As the dogs are displaced radially outwardly, the upper portions of the pins 144 are sheared and the retaining pins 132 move axially downwardly to engage the lower part of the stepped surface of the latching dogs under the action of the spring 134 and thereby retain the latching dogs in their outer position. This is illustrated best in the enlarged view shown in FIG. 6A of the drawings.

The tool and wear bushing can then be retrieved to the surface by pulling on the lines 122. The wear bushing is removed over any exposed casing connector prior to attachment of a casing/tubing hanger for completion of the operations in a conventional manner.

It will be apparent that the second embodiment of the invention has a significant advantage over the first embodiment in that it does not require the casing to be pulled in order to retrieve the wear bushing. The wear bushing can be retrieved to the surface without the need to pull back the casing.

It will be appreciated that the present tool can be adapted for use with a bowl protector in any size of casing or tubing.

What is claimed is:

1. A tool for use in retrieving a wear bushing positioned in surrounding relationship to a casing string from a wellhead assembly comprising:

a generally annular body portion which can be located around a length of casing positioned within a wear bushing within the wellhead assembly, means for supporting the body portion relative to a length of casing so that it can be lowered into a wellhead with said casing, and latching means carried by said body portion, said latching means being so shaped and arranged that it can engage a correspondingly shaped portion on said wear bushing, and means for actuating the latching means to move it into engagement with the wear bushing.

2. A tool according to claim 1, wherein said body portion comprises a ring-like part securable to a length of casing by a frangible means, and an outer sleeve carried by said ring-like part and connected thereto by frangible means, said outer sleeve incorporating means for engaging the wear bushing to correctly position the tool relative to the wear bushing.

3. A tool according to claim 2, wherein said engaging means comprises a shoulder formed on the outer surface of the sleeve.

4. A tool according to claim 2 wherein said latching means comprises segmented latch ring disposed intermediate said casing and said sleeve and having a plurality of downwardly depending legs which have latching heads for engaging the wear bushing.

5. A tool according to claim 3 wherein said latching means comprises segmented latch ring disposed intermediate said casing and said sleeve having a plurality of downwardly depending legs which have latching heads for engaging the wear bushing.

6. A tool according to claim 4, wherein said actuating means comprises a ring shaped member locatable around said casing such that it can be supported by a casing coupling element beneath said body portion, said ring shaped member having a generally frustoconical outer surface arranged to engage said legs of said latching means and urge said latching heads into engagement with the wear bushing by a wedging action.

7. A tool according to claim 1, wherein said body portion is suspended from one or more lines or cables and said body portion includes means for engaging the wear bushing to correctly position the tool relative to the wear bushing.

8. A tool according to claim 7, wherein said engaging means comprises a shoulder formed on the outer surface of the body.

9. A tool according to claim 7, wherein said latching means comprise a plurality of latching dogs carried by said body portion, said latching dogs being movable radially outwardly to engage a recess in said wear bushing.

10. A tool according to claim 8, wherein said latching means comprise a plurality of latching dogs carried by said body portion, said latching dogs being movable radially outwardly to engage a recess in said wear bushing.

11. A tool according to claim 9, wherein said actuating means comprises an energizing ring movable axially relative to the body portion so that it can contact said latching dogs to move them to their radially outward position.

12. A tool according to claim 11, wherein said body portion includes retaining means operable to retain the latching dogs in their radially outward position.

* * * * *